US007699365B2

(12) United States Patent
Liang et al.

(10) Patent No.: US 7,699,365 B2
(45) Date of Patent: Apr. 20, 2010

(54) SASH LOCK WITH CONDITION SIGNAL

(75) Inventors: Luke Liang, South Plainfield, NJ (US); Toni Liang, Guangzhou (CN); David Chen, Guang Zhou (CN)

(73) Assignee: Vision Industries Group, Inc., So. Plainfield, NJ (US)

( * ) Notice: Subject to any disclaimer, the term of this patent is extended or adjusted under 35 U.S.C. 154(b) by 0 days.

(21) Appl. No.: 11/254,065

(22) Filed: Oct. 19, 2005

(65) Prior Publication Data

US 2007/0085350 A1 Apr. 19, 2007

(51) Int. Cl.
*E05C 3/02* (2006.01)
*E05C 3/04* (2006.01)

(52) U.S. Cl. ..... 292/240; 292/241; 292/242; 292/DIG. 20; 292/DIG. 47

(58) Field of Classification Search ..... 292/240–242, 292/DIG. 47, DIG. 20
See application file for complete search history.

(56) References Cited

U.S. PATENT DOCUMENTS

| | | | | | |
|---|---|---|---|---|---|
| 229,894 | A * | 7/1880 | Kolb et al | ..... | 292/67 |
| 362,152 | A * | 5/1887 | Ferren | ..... | 292/210 |
| 2,421,196 | A * | 5/1947 | Granberg | ..... | 292/210 |
| 2,480,016 | A * | 8/1949 | Granberg | ..... | 292/336 |
| 2,846,258 | A * | 8/1958 | Granberg | ..... | 292/336 |
| 4,063,766 | A * | 12/1977 | Granberg | ..... | 292/336 |
| 4,736,972 | A * | 4/1988 | Mosch | ..... | 292/204 |
| 4,813,725 | A * | 3/1989 | Mosch | ..... | 292/241 |
| 5,161,839 | A * | 11/1992 | Piltingsrud et al. | ..... | 292/241 |
| 5,741,032 | A * | 4/1998 | Chaput | ..... | 292/202 |
| 6,068,306 | A * | 5/2000 | Brautigam | ..... | 292/242 |
| 6,142,541 | A * | 11/2000 | Rotondi | ..... | 292/241 |
| 6,357,806 | B1 * | 3/2002 | Saku | ..... | 292/182 |
| 6,848,728 | B2 * | 2/2005 | Rotondi et al. | ..... | 292/336 |
| 6,983,963 | B2 * | 1/2006 | Eslick et al. | ..... | 292/242 |
| 7,063,361 | B1 * | 6/2006 | Lawrence | ..... | 292/241 |
| 7,159,908 | B2 * | 1/2007 | Liang | ..... | 292/242 |
| 2005/0077735 | A1 * | 4/2005 | Generowicz et al. | ..... | 292/241 |

FOREIGN PATENT DOCUMENTS

JP 03129076 * 3/1991

* cited by examiner

*Primary Examiner*—Carlos Lugo
(74) *Attorney, Agent, or Firm*—Thomas A. O'Rourke; Bodner & O'Rourke, LLP

(57) ABSTRACT

A sash lock for a sash window assembly where the sash window assembly includes an upper sash window and a lower sash window, each of the sash windows being mounted within opposed guide rails on a master frame wherein at least one of the sash windows is slidable within the frame relative to the other sash window. The sash lock has a housing for mounting on a stile of one of the sash windows and a keeper for mounting on a stile of a second sash of the window. The housing has a locking assembly comprising an actuator and a catch. The actuator is adapted to move the catch. The catch is adapted to engage and disengage a keeper as the actuator is moved from a first position to a second position. The movement of the catch from a first position to a second position causes an indicator in the housing to signal whether the locking assembly of the sash lock is in locking position.

29 Claims, 8 Drawing Sheets

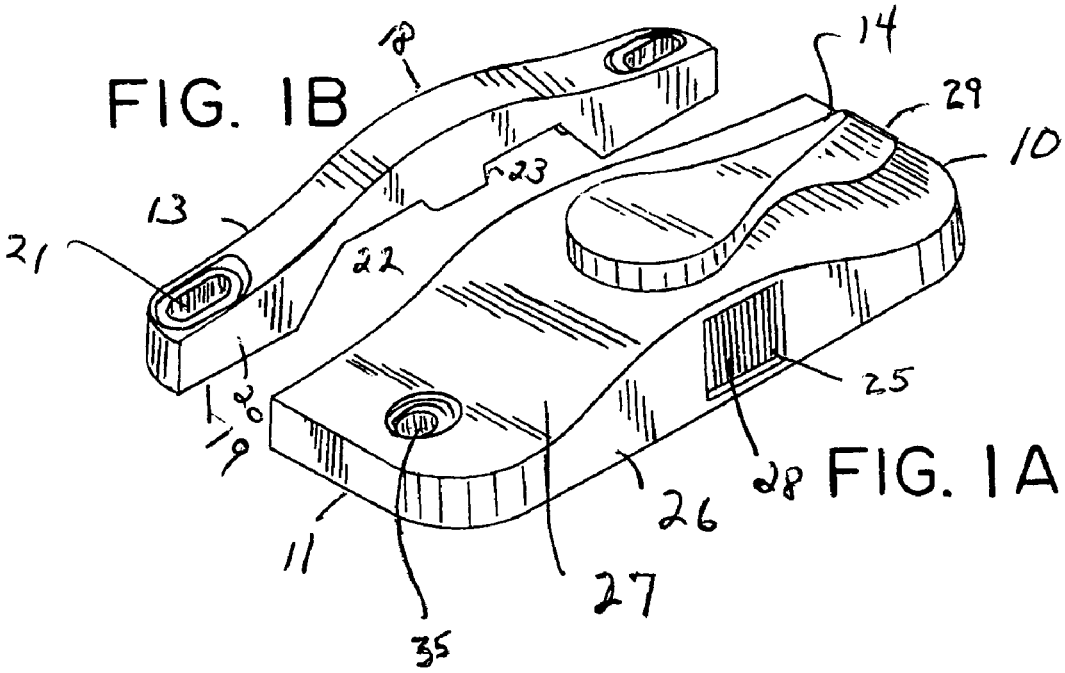
FIG. 1B
FIG. 1A
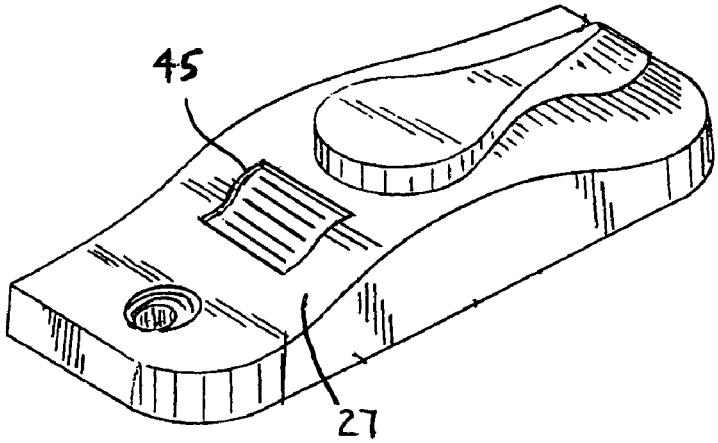
FIG. 1C

SASH LOCK WITH CONDITION SIGNAL

This application claims priority on U.S. Design application Ser. No. 29/237,478, filed Aug. 31, 2005, the disclosures of which are incorporated herein by reference.

FIELD OF THE INVENTION

The present invention is directed to improvements in the field of window locks and, in particular, sash locks for double hung windows.

BACKGROUND OF THE INVENTION

Double hung windows are typically positioned in a frame and have a top sash and a bottom sash. The sashes are each positioned in a channel on each side that permits the sashes to be moved from an open position to a closed position. The sash will have one or more panes of glass framed by the sides of the sash.

In many applications the double hung windows are opened for ventilation. Traditionally warm air from a room exits from the opening formed by the top sash. When the top sash is lowered cooler air from the outside enters a room through the bottom sash when that sash is raised.

One of the issues with double hung windows is security. In order to prevent unauthorized ingress or egress through a double hung window, many building personnel and homeowners use sash locks to secure the window from opening. Traditionally, the sash lock has a handle for moving a securing member into and out of a locked position.

One sash, usually the lower sash, has a sash lock secured to the upper surface of the top horizontal member. This lock secures a catch to a keeper positioned on the opposite sash. The keeper is usually mounted on the inside surface of the lower horizontal member of the upper sash.

One of the issues that many users have with sash locks relates to determining whether the sash lock is in a locked or unlocked arrangement. Many homeowners and/or business establishments that have double hung windows have a number of double hung windows on their premises. At any given time some of the windows may be opened and the remainder closed. When a business is closing for the night or a homeowner is locking up the house because he will be away from home for one reason or another, all the windows should be locked for safety reasons. Many homes can have twenty or more double hung windows, each of which must be individually checked to determine if they are locked. Traditionally the user would have to manually check each individual lock to determine whether it is locked or not. This is time consuming and subject to errors by the user. Accordingly, there is a need for an improved sash lock system so that its locked status can be readily ascertained.

OBJECTS OF THE INVENTION

It is an object of the invention to provide an improved sash lock.

It is an object of the invention to provide an improved sash lock that will signal its status of being in a locked or unlocked position.

It is an object of the invention to provide an improved sash lock that will signal a user that a sash lock is in a locked position.

It is an object of the invention to provide an improved sash lock that has a signaling mechanism that provides a clear signal that a sash lock is in a locked position.

It is another object of the invention to provide an improved sash lock that has a signal means within the housing of a sash lock.

It is a further object of the invention to provide a sash lock that improves security.

It is a still further object to provide a sash lock that will reduce the risk of ingress to a premises through a window.

It is an object of the invention to provide a sash lock that readily permits a user to determine whether a window sash is in a locked position.

It is another object of the invention to provide a sash lock assembly having an improved housing for providing a visual indication whether the sash lock is in a locking position.

It is also an object of the invention to provide a sash lock that has a visual signal in the housing for showing whether the lock is in a locking configuration.

SUMMARY OF THE INVENTION

The present invention is directed to an improved sash lock that has an indicator means for ascertaining whether a sash lock is in a locked or unlocked position. The present invention has a housing with a locking assembly positioned in the housing and a keeper, which is secured to the sash lock, by the locking assembly when a catch is in an extended position. The sash lock and the keeper can be a variety of different shapes. The sash lock has a housing with one or more orifices for receiving a screw or other means to secure the housing to the window sash. Extending from the housing is an activator arm, which is rotatably secured to the locking assembly by means of a shaft. As the activator arm is moved from one position to the other, the locking mechanism moves from a locked position to an unlocked position and vice versa.

The locking assembly usually has a cam or a catch or other securing means that extends to secure the lock with the keeper and retracts to release the keeper. When the catch extends to its locking position, it secures a keeper to the sash lock. The keeper typically has a top portion, a bottom portion and one or more sidewalls. In at least one of the sidewalls, there is an open portion or area. The top surface has one or more orifices that extend through the top surface to the bottom portion for securing the keeper to a sash. Usually in the open portion there is a flange or other member extending from the underside of the top surface of the keeper so that the sash lock can be secured to the keeper.

One of the key features of the present invention is the presence of a signaling means for signaling the status of a lock to a user. This signaling means is present in the sidewall or top surface of the sash lock and permits a viewer to readily ascertain the status of the sash lock. In one embodiment the signaling means is one color when the sash lock is in an extended condition, i.e. a locking condition, and another color when it is in a retracted or unlocked condition. For example, the indicator may be white when the catch of the sash lock is in an extended or locked position and red when the catch of the sash lock is in a retracted or unlocked position. Other color combinations can be used.

In a preferred embodiment of the present invention, the housing is provided with an orifice. This orifice can be on a side surface or on a top surface of the sash lock. This orifice permits a viewer to see an indicator on the side or top of the cam or catch. The indicator can be a colored indicator or other visual means on the activator to signal the status. In another embodiment the housing of the sash lock may be clear or have a clear or see-through portion where one or more indicators on the catch may be viewed.

While a color can be used as the indicator, other indicators can be used as well. For example, there can be a tactile signal such as a raised portion or a recessed portion that can be used.

In another embodiment of the invention, the sash lock of the present invention can provide increased security from forced entry. In this embodiment, the locking mechanism portion of the latch may have a handle, a housing, a first and a second cam. The handle of the invention preferably includes the manually graspable portion of the handle, resistance providing member, preferably a conventional spring, a sliding member, and a member that provides restriction to movement of the sliding element. There is also a shaft attached to the handle which extends from the underside of the handle and holds the first and second cams. The spring with the sliding member positioned on it, is compressed and placed into the inner cavity of the handle in such manner that the sliding member may move back and forth generally along the line perpendicular to an axis of rotation of the handle. The top portion of the housing of the latch may be formed in a shape of a cylindrical extension with an opening in a center of such extension. The extension generally may have two diametrically opposite notches made on the side surface of the extension. Such notches may be made in order to provide a positive tactile indication that the handle is in the "locked" or "unlocked" position respectively. While the spring, with sliding member positioned on it, remains compressed, the handle may be assembled with the housing in such manner that the end of the sliding member is pressed against the side surface of the cylindrical extension. If the handle is rotated relative to the housing, the end of the sliding member may slide around the side surface of the cylindrical extension remaining pressed against the surface, and may be able to "snap" into the notches made in such extension, providing a positive indication of the handle positioning relative to the housing of the latch. The spring may provide resistance necessary to rotate the handle from the position when sliding member is "snapped" into a detent in order to prevent forced entry as well as accidental and unintentional rotation of the handle.

The present invention may include two cams. The handle preferably includes a pivot shaft coupling the housing of the latch and cams in pivotal relation to each other. Both cams are preferably positioned on the handle shaft and under the housing. The first cam may be configured in such manner that while being rotated around its axis, the cam may engage the keeper, thus locking and unlocking the latch. The first cam may have a groove in order to provide engagement with the keeper. Also, the first cam may have another groove that would mate with the protrusion made on the inner surface of the housing. When the cam engages the protrusion, the cam may not be rotated. Similarly, when the first cam does not engage the protrusion, the cam may be rotated. The first cam and the protrusion may be configured in such way that the first cam could engage with the protrusion and the keeper at the same time.

Both cams may have orifices so that they may be positioned on the shaft of the handle. Because the diameter of the orifice of the first cam may be bigger than the diameter of the shaft upon which the cam is positioned, the rotation of the shaft does not affect the cam. The second cam is preferably positioned underneath the first cam and provides the rotation from the handle to the first cam. The cam that engages the keeper may be configured to shift the axis of its rotation relative to the axis of rotation of the handle shaft. It would allow to such cam not only to rotate around its axis, but also to be shifted in the direction perpendicular to it. It would make it possible for the first cam to disengage with the second cam and to engage with protrusion made on the inner surface of the housing and vise versa. Because of their configuration, when the cams are disengaged, the rotation of the second cam would not affect the cam that engages the keeper. This impermanent engagement of the cams may be provided by the combination of the groove made in the first cam and the protrusion made in the second cam. Because the first cam may not rotate when it engages with the protrusion made in the inner side of the housing, the same cam may not disengage with the keeper. Therefore, the latch would remain locked unless the first cam disengages with the protrusion on the housing. In such configuration, rotation of the handle would rotate the second cam. At some point, the first cam would be released from the engagement with the protrusion made in the housing, and then the second cam may engage the first cam and both may rotate thus disengaging the first cam and the keeper and unlocking the latch.

BRIEF DESCRIPTION OF THE DRAWINGS

FIG. 1A is a perspective view of the sash lock of the present invention.

FIG. 1B is a perspective view of a keeper for use with the sash lock of FIG. 1A.

FIG. 1C is a perspective view of an alternate keeper for use with the sash lock of FIG. 1A.

DETAILED DESCRIPTION OF THE INVENTION

Figure 2:
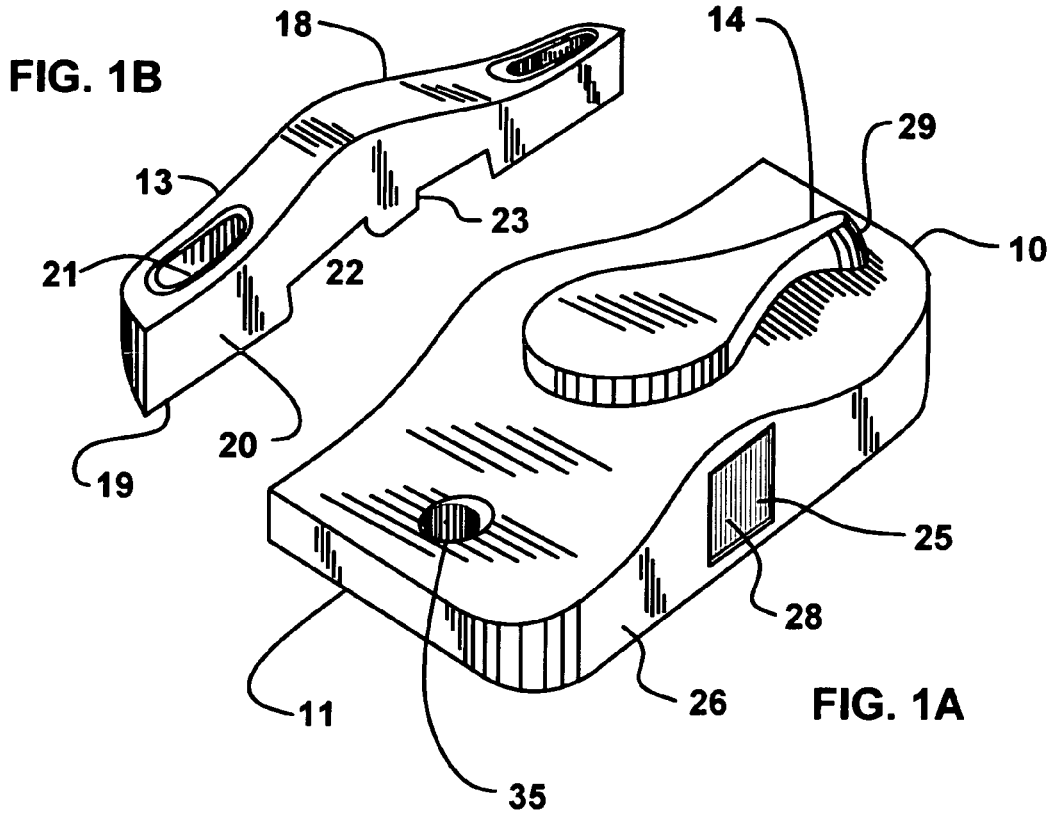
FIG. 2 is a side view of the housing of the sash lock of the present invention.
Figure 2:
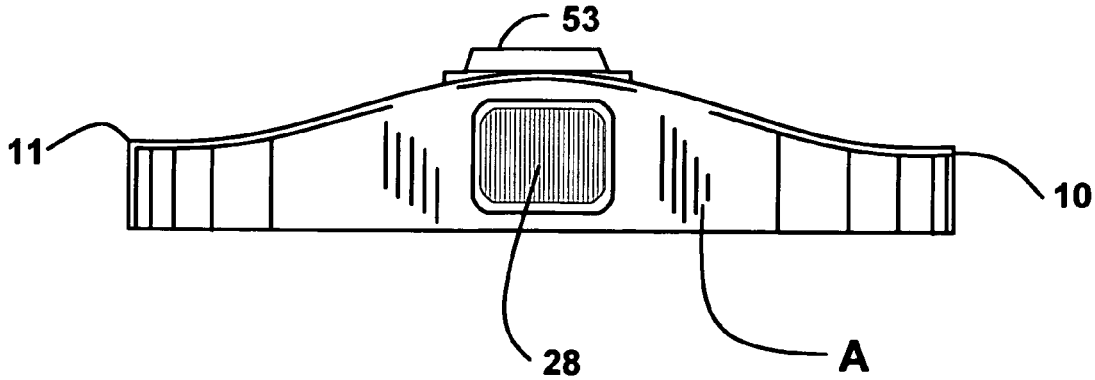
Figure 4:
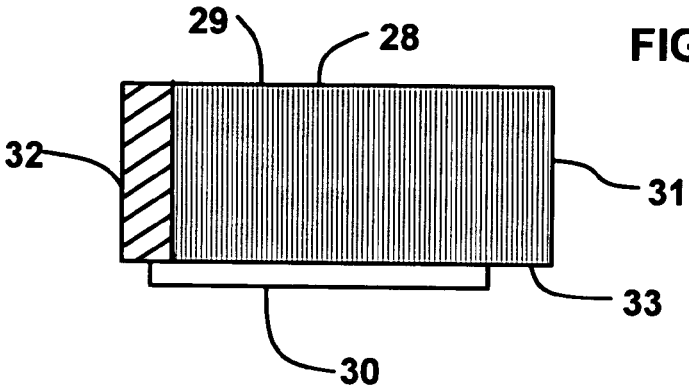
FIG. 4 is an end view of the first cam of FIG. 3 taken from direction A.

While this invention is susceptible of embodiment in many different forms, there is shown in the drawing and will herein be described in detail preferred embodiments of the invention with the understanding that the present disclosure is to be considered as an exemplification of the principles of the invention and is not intended to limit the broad aspect of the invention.

The sash window assembly on which the present invention may be used may include an upper sash window and a lower sash window. Each of the sash windows may be mounted within opposed guide rails on a frame. At least one of the sash windows is slidable within the frame relative to the other sash window. The present invention may also be used in a single sash window that is hinged on one end and lockable on the opposite end. These windows typically open inwardly or outwardly and can be held in place by a chain or other means when opened.

As seen in FIG. 1A there is a sash lock 10 having a housing 11 which has a locking assembly 12 within the housing for securing the sash lock to a keeper 13. The sash lock 10 is typically secured to a first window sash. The keeper 13 is secured to a second window sash. The sash lock may be any suitable shape desired. The locking assembly 12 has an actuator arm 14 secured to a catch or cam by means of a shaft 15. The catch may be any suitable catch used in the art. The catch typically has a member with a catch or opening for receiving or securing the sash lock to the keeper. Various sash locks catch arrangements are known in the art that can be used with sash lock of the present invention, including but not limited to U.S. Pat. No. 2,421,196, U.S. Pat. No. 2,480,016, U.S. Pat. No. 2,846,258, and U.S. Pat. No. 4,063,766, the disclosures of which are incorporated by reference. Other catch means can be used as well, as can a magnetic arrangement for securing the sashes together. In a magnetic arrangement, there is a pair of magnetic members. One magnetic member is on the keeper and the other is on the catch. At least one of the magnetic members is a magnet that is secured to or constitutes one of the keepers on the catch. The other member is either a magnet or a material that is attracted to a magnet.

Alternatively, the arm 14 may pivot a first cam 16 to which the securing means or catch 17 is connected. As the arm rotates, the first cam moves until a selected point whereupon the catch 17 of the cam 16 begins to move to engage a portion of the keeper. The actuator arm 14 preferably includes a handle 29 or a driving or gripping portion that permits the user to readily move the catch 17 into a locked position engaging the keeper 13. The movement of the actuator arm 14 also causes the catch or cam to release the keeper when the window is being opened.

As seen in FIG. 1B, the keeper has a top portion 18 and a bottom portion 19. Extending between the top surface and the bottom surface are one or more sidewalls 20. Through the keeper are usually one or more orifices 21 for securing the keeper to the sash. On one of the sidewalls of the keeper, there is usually an open area 22 for receiving the catch on the sash lock. The catch on the sash lock interacts with the member 23 that extends into the open area from the underside of the top surface of the keeper. In a typical assembly, the catch 17 has a hook shaped portion or sloping portion 24 that engages member 23 on the keeper and retains the keeper in a locking position.

The housing 11 is provided with an opening 25 in one of the sidewalls 26 of the housing or opening 45 on the top wall 27 of the housing. This opening 25 permits a signal means 28 to inform a user of the status of the locking mechanism and whether the mechanism is in a locked or unlocked position. When the first cam 16 moves into a locked position a signal means 28 on the cam moves to a signaling position. The cam has a top surface 80, a bottom surface 30 and a side wall 31. One portion of the side wall 31 is provided with a signaling means 28. The signaling means 28 is preferably a first color 32 and a second color 33. When the cam is in a locked position one color of the signaling means is in position by the opening 25 informing a user of the status of the lock. When the catch is in an unlocked position another color of the signaling means is in position by the opening, thus informing a user that the lock is in an unlocked relation. Thus, for example, the sidewall 31 of the catch 16 may have a red patch on the surface thereof and a white patch. When the catch is in a locked position, the white patch shows through the opening 25 in the sidewall 31 of the housing. While colors can be used as the signaling means, there may be tactile indicators such as raised or recessed portions that would indicate to the user whether the sash lock is in a locked or unlocked position.

Figure 8:
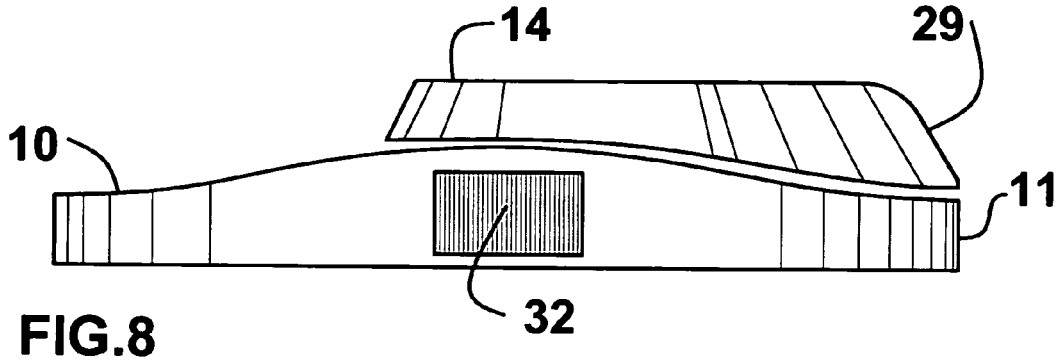
FIG. 8 is a side view of the sash lock in an open position.
Figure 9:
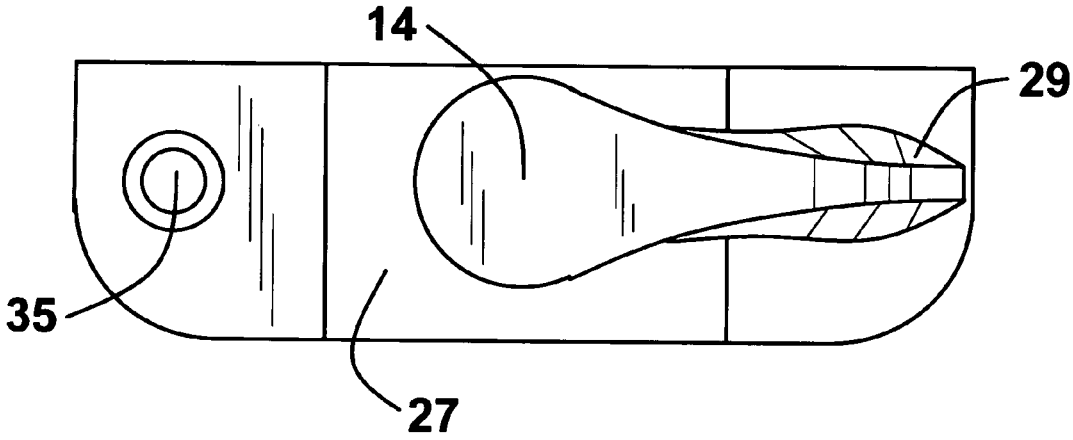
FIG. 9 is a top view of the housing of FIG. 8.
Figure 10:
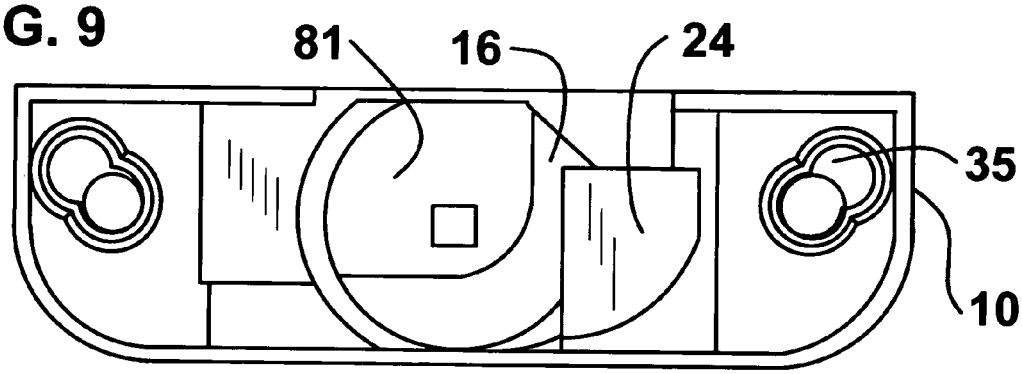
FIG. 10 is a bottom view of the housing of FIG. 8.
Figure 12:
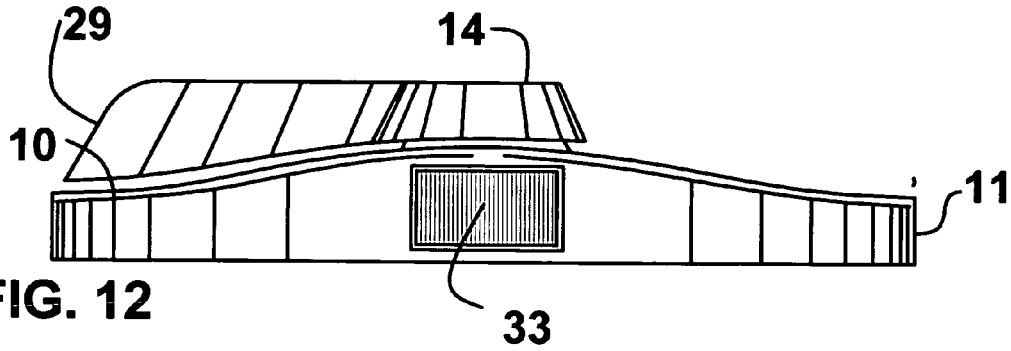
FIG. 12 is a side view of the sash lock of FIG. 1 with the activator in a closed or locking position.
Figure 13:
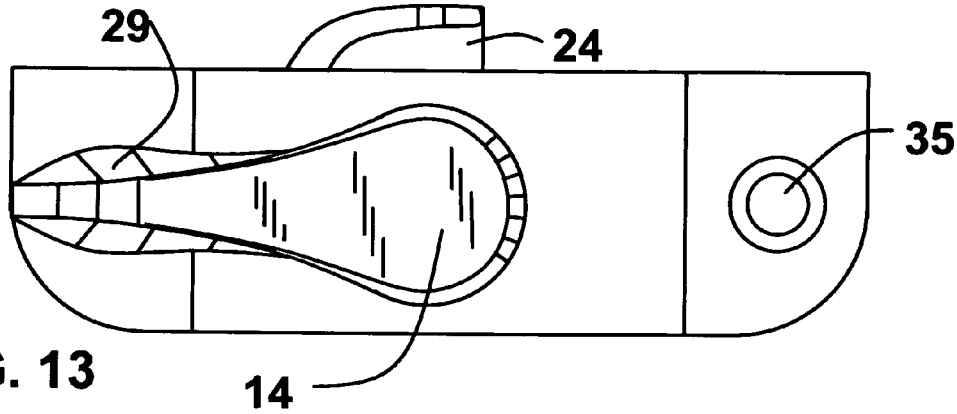
FIG. 13 is a top view of the housing of FIG. 12.
Figure 14:
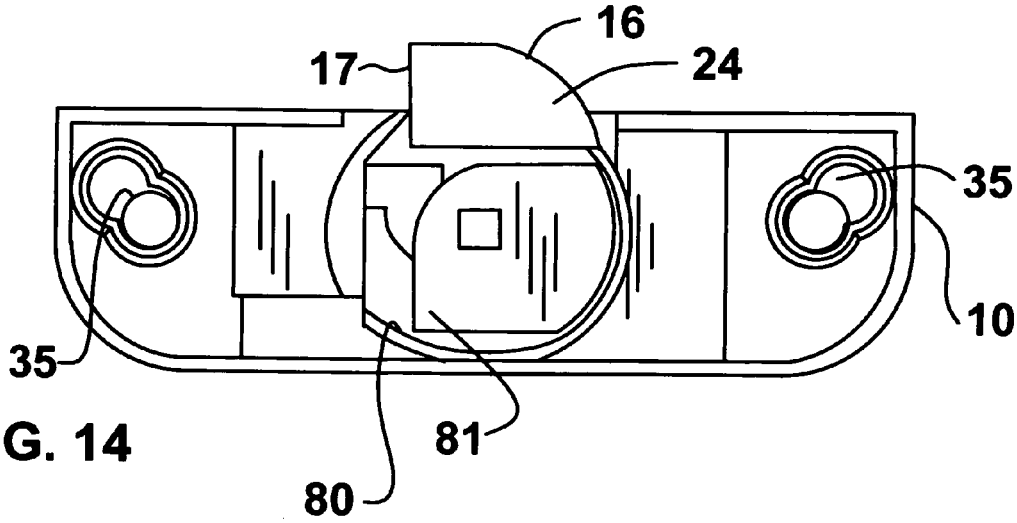
FIG. 14 is a bottom view of the sash lock of FIG. 12.
Figure 15:
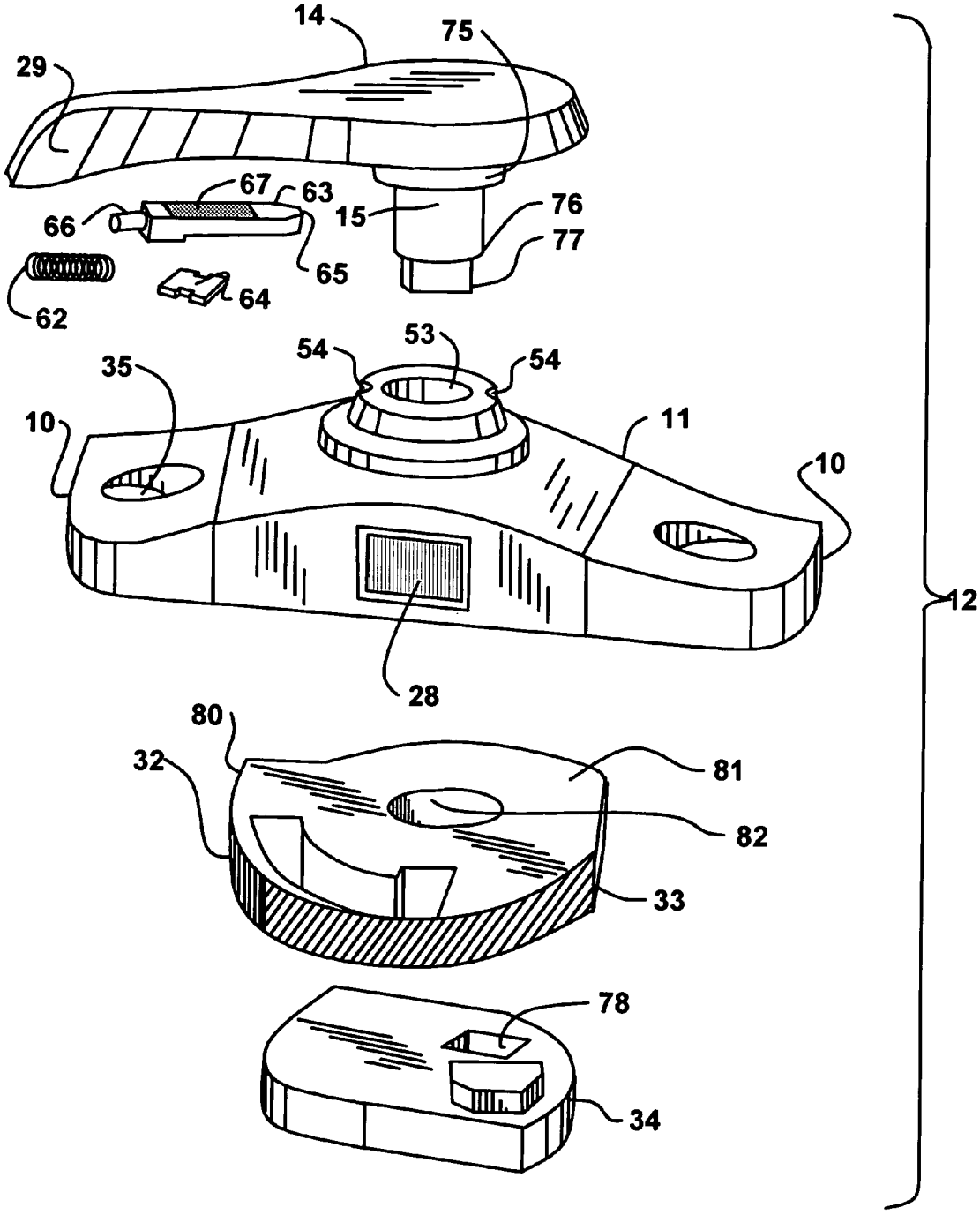
FIG. 15 is an exploded view of the sash lock of FIG. 12.

The housing 11 is secured to a surface on the stile of a sash. The actuator arm 14 has typically two positions. The first is a locked position as seen in FIG. 12 and an unlocked position as shown in FIG. 8.

Figure 3:
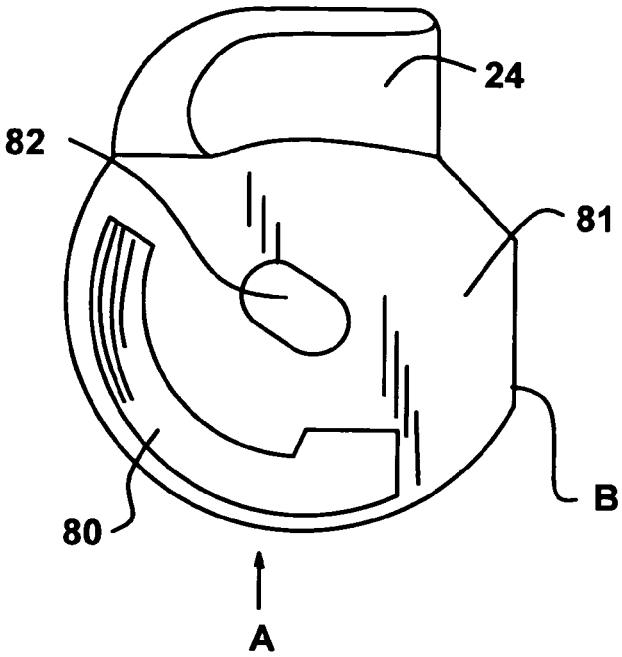
FIG. 3 is a top view of the first cam of the sash lock.
Figure 5:
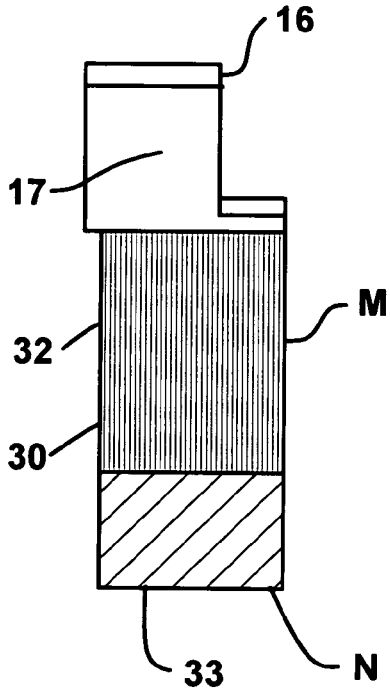
FIG. 5 is an end view of the first cam of FIG. 3 taken from direction B.
Figure 6:
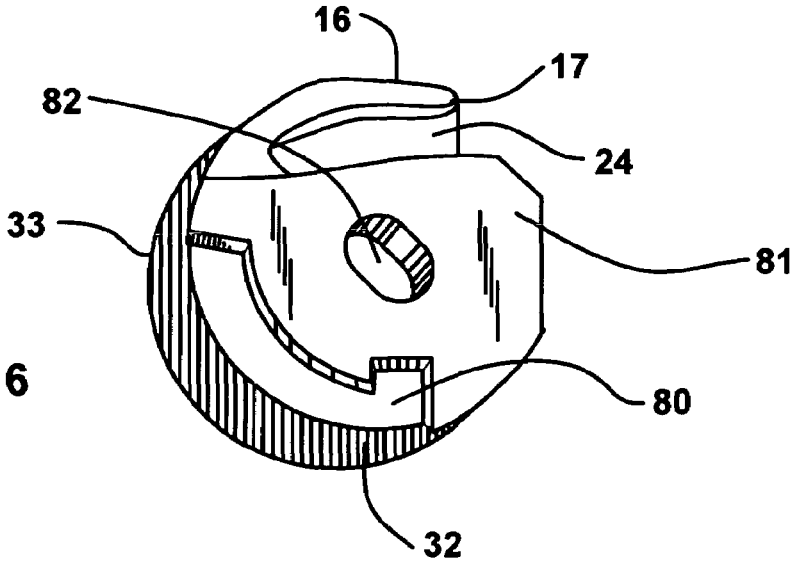
FIG. 6 is a perspective view of the top of the first cam of FIG. 3.
Figure 7:
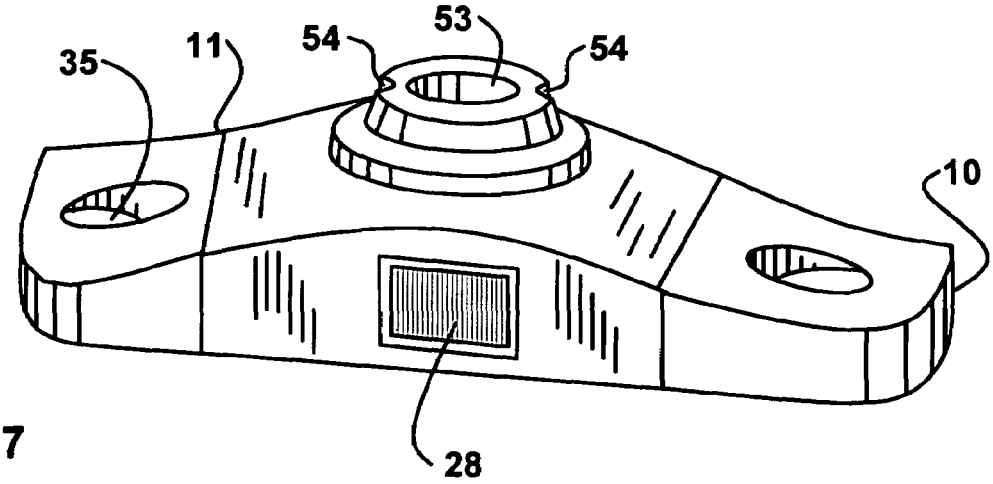
FIG. 7 is a perspective view of the housing of FIG. 2.

FIG. 3 shows the cam 16 that the actuator arm 14 operates. In this embodiment the cam 16 has a sloped portion 24 that is moved by the actuator arm 14. The cam can perform two functions in the present invention. The first is to secure the locking assembly to the keeper to prevent the window sash from opening. The second is that it provides a location for the signal means so the signal means can indicate whether the catch is in a locked or unlocked position. In FIG. 8, the arm 14 turns the cam 16, the surface of the sloped member 24 of the catch or cam 16 contacts and secures the member 23 on the keeper. As the catch or cam 16 is rotated by the actuator arm 14, the portion of the cam sidewall that has the signal means is turned into position to show a locking position or an unlocked position.

A preferred mechanism of the present invention has a housing with a top surface and at least one sidewall. The housing may be any shape. In one embodiment, there is a front sidewall and a rear sidewall that are joined by a pair of endwalls. The top surface of the housing has a pair of orifices 35 for receiving a screw or nail or other means to secure the housing to a window sash. There is a further orifice that extends through the top surface. This orifice receives a shaft 15 on the actuator arm. The actuator arm turns a catch by means of the shaft. The catch may be secured to the shaft by any suitable means such as by means of a washer that is positioned on the underside of the catch. A screw passes through the washer and enters a threaded portion of the shaft. In another embodiment, there may be a cam secured to the shaft. The cam provides increased security as it prevents a person outside the house from moving the catch from a locked position to an unlocked position.

The housing 11 may generally be any suitable shape. In one embodiment the housing may be generally rectangular in shape with preferably two square corners on the side of the sash lock that is closest to the keeper 13, and on the opposite side of the housing there may be two rounded or squared corners depending of the "look" or style of the sash lock. Viewing the sash lock from the side having the squared corners, the housing has an open cavity, which for example, may resemble an arch or raised portion. Residing in the cavity are the first cam or catch 16 and the delay cam 34 which are preferably covered by the housing. Housing 11 may be provided with two screw holes 35 to mount the latch to the window sash. Underneath these holes the housing may have two pillars (not shown) that have such length that when latch is placed on a flat surface, the bottom of each pillar would generally touch the surface. Both pillars may serve to reinforce the housing's resistance to the possible deformation and prevent tension between moving parts of the latch when they rotate relative to each other. Such tension may emerge due to existence of the force upon the housing when screws that attach housing to the window sash are tightened. The pillars may, for example, have an oval shape although other shapes are possible. The screw holes for mounting of the housing to the window sash may be drilled through such pillars for aesthetic and reinforcement purposes, although other placements for holes are possible.

It is preferable that the handle 14 of the latch has an ergonomic shape. To provide a convenient grip, the handle's grasping area may, for example, be generally trapezoidal with wider bottom and narrower top if the handle is viewed from the front, and if viewed from the top, the same handle may be relatively wide at the end, becoming narrower toward the middle, forming a "neck", and than getting wider again. The handle of such shape would be very convenient to operate. The curves and corners, lengths and widths of different parts of the handle may vary to achieve the best result.

Next, in order to secure the position of the handle of the invention as either "locked" or "opened," and at the same time to provide the user of the invention with the resistive tactile feeling that corresponds such positions of the latch, the lock may employ a variety of possible embodiment of such features. In one example, the handle or actuator 14 connected with the locking mechanism, may rotate around its axis, preferably about 180 degrees, and while rotating, the handle should be able to "snap" into such designated positions as to indicate for the user that the latch is locked or opened and also to prevent forced entry when in the locked position. In this embodiment, as a part of the housing 11, there may be a ring or an extension 53 on the top surface of the outer shell of said housing. The ring may be in the shape of a cylinder or a cone with low profile or height above the surface of the housing. The ring may be integral with the housing or may be a separate member. On the side surface of said extension there may be two detents or notches that would designate the locking and unlocking position of the latch, although such extension and detents may have different configuration to serve the same functions. Alternatively, there may be slight protrusions on the ring that can accomplish the same purpose. This extension of the housing may have an opening, preferably round and in the middle, through which the shaft of the handle 14 is passed through and within which such shaft may freely rotate. In a preferred embodiment, the extension 53 may also have two diametrically opposite V-shaped notches 54 on the side surface of said extension 53 that extend from the upper surface of the ring to the bottom surface of the ring along the length of the sidewall.

The handle 14 may have a shaft, which passes through the housing from the outer side of the extension 53, then through the first cam 16, then through the delay cam 34. In a preferred embodiment, the handle has a cavity 44, such as a cavity having a generally trapezoidal cross section underneath the upper surface of the handle that accommodates the spring 62, the bar 63 and the plate 64.

As was mentioned above, notches may be made in order to provide a positive tactile indication that the handle is in the "locked" or "unlocked" position respectively. In a preferred embodiment, the bar 63 may be positioned so that the compressed spring 62, and the bar 63 are within the cavity of the handle with the spring located at the side of the handle opposite the end connected to the shaft. If the handle in present configuration is then positioned on the housing, the movement of the spring would thrust the bar forward toward the side of the extension 53. That would allow the bar to contact the side surface of the extension 53 when the handle revolves around its axis relative to the housing, and to be able to "snap" into designated notches 54. The position of the handle, when the bar is "snapped" into the notch, would correspond to an "opened" or "locked" position of the latch. The notches would be preferably V-shaped indentations, or detents, or cuts, or recesses of a similar shape made in the side surface of the extension 53 such as a U-shaped recess, etc. Similarly, the corresponding end 65 of the bar that would "snap" into such notches would be preferably a shape corresponding to the shape of the recess so that the bar and recess mate. The corresponding end 65 of the bar 63 is generally V-shaped to correspond to the shape of the notches in the extension 53. Such shape of the notch and the corresponding counterpart of the bar may be dictated, on the one hand, by the compromise between the necessity of the relatively effortless rotation of the handle from the position when the bar is "snapped" into the notch, and some resistance, supplied by the spring 62, which is essential in order to prevent forced entry as well as an accidental and unintentional rotation of the handle.

The housing 11 of the latch may have protrusion (not shown) positioned on the inner side of the top surface of the housing. The protrusion has a first end and a second end and can slope upwardly from the first end to the second end. The purpose of the protrusion is to prevent the movement of the cam 16 relative to the housing and in order to keep the cam 16 engaged by delay cam 34. Because the protrusion may contact the side surface of the cam 16, one side of such protrusion may be rounded to resemble the side surface of the cam 16 in order to better accommodate the contact.

In order for the bar 63 to "snap" into the notches made on the side surface of the extension 53, the tip 65 of the bar should slide around the extension 53 as the handle is turned, while generally remaining pressed against the side surface of the latter. Such pressure may be supplied by the spring 62 or any similar device that may function in the similar way and provide thrust to the bar. Positioned on the stem 66 of the bar 63 and compressed, the spring 62 would thrust the bar toward to and press it against the extension 53. Therefore, in order for the bar 63 to be pressed against the side of the extension, the bar should preferably have such configuration that when coupled with spring 62, the latter, while remain compressed, thrust the bar 63 to engage with extension 53.

To couple the spring 62 and the bar 63 various combinations may be used. For example, the bar may have a blind bore on its end and the spring is positioned within the bore. Or, for example, like in the present embodiment, the bar or the stem 66 of it may be positioned within the spring. In order to avoid the disfigurement of the spring and provide the evenly distributed compression when the spring is positioned on the bar and then compressed, the cross section of the bar should preferably have generally the same shape as the cross-section of the spring. Thus, with the purpose to accommodate the spring, the embodiment shown in the Figures has the bar that generally has a cross-section that resembles the cross-section of the spring. In order for the spring, if compressed and positioned on the bar, to move jam-free, the diameter of cross-section of the spring generally should be somewhat wider that the diameter of the cross-section of the counterpart of the bar. It will be appreciated by one skilled in the art that the cross-section of the stem 66 can be any cross-section that supports the spring. Similarly, if a recess is used in the bar its cross-section may be any configuration as long as it receives and retains the spring. One possible variation of such shape of the bar is a cylinder of smaller diameter than the diameter of the spring positioned on it. Therefore, at least one part of the bar that would bear a spring may have a shape of cylinder.

As was shown, the bar may embody different configurations in order to accommodate the spring and to prevent the spring from sliding outwardly from the bar if such spring should be compressed. Moreover, because the present embodiment may have a bar that engages the housing extension 53, and therefore, may contact the surface of the side of such extension, at least one end of such bar should bear no spring positioned on it. One possible solution is to make extensions somewhere on the body of the bar that would prevent the spring, once positioned on the bar, from sliding further if such spring is compressed. Except that width of the cross-section of such bar at the place where such extensions expand from the bar should be bigger than the cross-section of the spring in order to prevent sliding of such spring, the shape of the extensions may vary. Another solution is to make a stepped shoulder on the bar that shows an increase in diameter or width in cross-section. Such shoulder would prevent the spring from sliding along the bar when spring is compressed. Therefore, while one portion of the bar that accommodates the spring may be preferably cylindrical, the other portion of the bar may have any shape provided. It is also preferred that the portion of the bar that is not intended to bear the spring be guarded by either extensions or stepped shoulder of wider diameter or by any other change in shape of the bar, to prevent the spring, once positioned on the presumably cylindrical end of the bar, from sliding toward the other end if such spring is compressed.

This embodiment may have a bar that has two portions 67 and 68. One portion 67 would accommodate the spring. The end of the other portion or body 63 would be pressed against the side of the extension or rim 53. Both portions may be separated by the end plate that would prevent the spring, once positioned on one end of the bar and compressed thereafter, from sliding toward the other end, and therefore, thrust the bar toward the extension 53.

As was indicated, one portion of the bar, i.e. the stem 66 may be generally cylindrical. The other portion of the body may have any shape, but because the bar with the spring positioned on it may be embodied in the handle in such way that the bar contacts the side surface of the extension 53 of the housing, the shape and the size of the second or body portion of the bar 68 may be required to, fit the space provided within the trapezoid inner cavity of the handle. Because the handle of the invention may preferably remain as smaller as possible for the purposes of convenience and aesthetical demands, the configuration of the inner cavity would determine possible shapes and sizes of the bar.

The desirable thrust may be achieved by the compression of the spring between at least two surfaces. One such surface may be formed by the end plate or surface that divide the bar 63 as was shown above. The second surface may be formed by partition (not shown) that may be, for example, an integrated part of the inner cavity of the handle. The partition may be generally perpendicular to the handle and aligned along the inner cavity in order to better secure the compressed spring in such cavity of the handle and to prevent the spring-bar assembly from dislocation in vertical and horizontal direction. The partition may vary in shape in order to better secure the positioning of the spring. For example, the partition may have an extension that may extend toward the spring, and upon which the spring is positioned. The location of the partition within the cavity of the handle may be determined by the length of the bar with the compressed spring positioned on it. Because the bar contacts the side surface of the extension 53, the partition may be situated within the cavity in such manner that when bar-spring assembly with compressed spring is embodied in the cavity and pressed against the partition, the spring provide sufficient resistance to thrust the bar toward the extension 53 and to press it against the side surface of said extension. However, the length of the bar and the spring may be also regulated in order to achieve desirable resistance to the rotation of the handle.

To prevent the spring or the bar within the cavity of the handle from falling down from the cavity, a plate 64 may be positioned over the cavity of the handle or a portion thereof to support such assembly. The configuration of such plate and the method by which the plate is secured in the cavity of the handle may vary. Present invention, for example, may use the plate rectangular with low profile. Because the handle may be trapezoid in cross-section, the friction created between the inclined side walls of the handle and the plate may hold the plate 64 in place when such plate is positioned horizontally into the cavity and then firmly pressed.

Figure 11A:
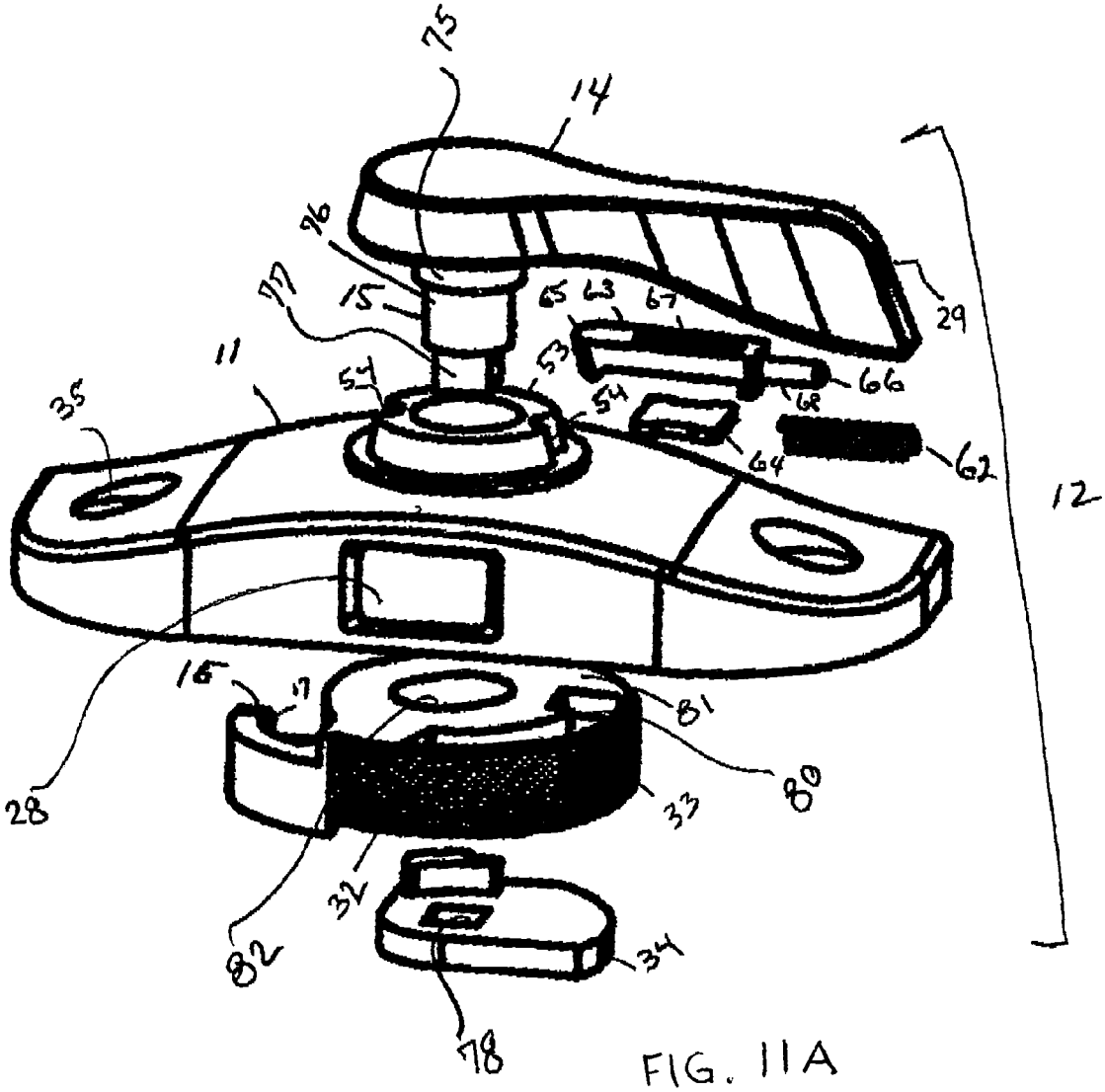
FIG. 11A is an exploded view of the sash lock of FIG. 8.
Figure 11B:
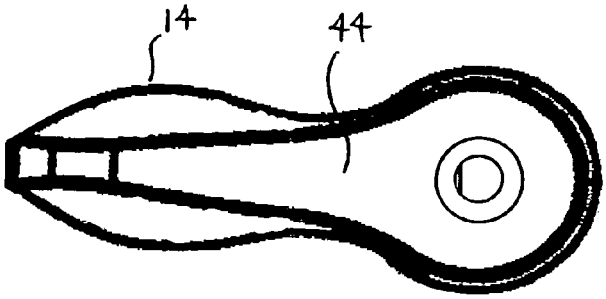
FIG. 11B is a bottom view of the Actuator Arm of FIG. 11A.

The handle's shaft may have three different portions 75, 76 and 77, along to the length of the shaft, as depicted in FIG. 11. First portion 75 of the shaft may have a cylindrical shape. It may begin from the top where the handle attaches to the shaft, and then continue downwardly for approximately the height of the cylindrical extension 53. The diameter of the cross-section of the shaft at the first portion 75 is preferably slightly less than the diameter of the rounded opening made in the extension 53. Such configuration of this portion of the shaft is desirable in order to secure the revolving movement of the shaft within the opening of the extension 53 without undue friction between the shaft and such opening, and at the same time to minimize angular misalignment of the shaft relative to the housing. Then, approximately at the point where the handle's shaft reaches the cam 16 that is positioned next to the housing, the configuration of the shaft may be in a form of a cylinder. Because this portion 76 of the shaft may be positioned through and revolve without undue friction within the opening made in the cam 16, the cross-section of such portion of the shaft is preferably smaller than the size of said opening in order for the shaft to revolve without undue friction within the opening 82. The length of the portion 76 is preferably about the height of the cam 16. At that point, the configuration of the shaft preferably changes from a cylinder to a generally rectangular portion 77 which may be square in cross-section in order to accommodate the square traverse opening made in the delay cam 34. Such configuration of the shaft and corresponding opening 78 in the delay cam 34 may be chosen in order to provide firm connection of said shaft with the delay cam although other configurations may be used. Therefore, the lower portion 77 of the shaft is preferably to fit the traverse opening 78 in the delay cam 34 thus allowing firm connection between the handle 14 and the delay cam 34; the rotation of the former would causes the rotation of the latter.

While the handle shaft is passed through the housing 11, the cam 16 and the delay cam 34, the end of the shaft opposite to the handle end of the shaft may be provided with a head to keep the handle 14, the housing 11, the cam 16 and the delay cam 34 on the same rotation axis in the preferably following order: the shaft is first positioned through the traverse round opening on the housing 11, then the shaft is passed through the traverse opening 82 in the cam 16, then the shaft is passed through the square traverse opening 78 in the delay cam 34 and then the head is formed at the end of the shaft.

The present invention may have a first cam 16. This cam may serve three different purposes at the same time: it may engage the key 23 of the keeper 13 in order to lock and unlock the latch, it may engage the protrusion on the housing 11 in order to prevent rotation of said cam, and it may engage the delay cam 34 which protects the cam 16 so that an intruder will not be able to access the underside of cam 16. In order to be able to perform all these functions, the configuration employed by the present invention of the cam 16 may preferably resemble a generally disk shaped member with rounded corners, its height/width ratio may vary to fit the dimensions of the housing in order to be accommodated by the latter, the length of the shaft and the position of the keeper. The cam 16 has a sloped portion 24 and a groove 80. The groove 80 receives the pin or protrusion extending from the underside of the housing. The operation of the first and second cams 16 and 34 are described in more detail in our copending application, Ser. No. 10/971,566, the disclosures of which are incorporated herein by reference.

We claim:

1. A sash lock for a sash window assembly comprising a housing; said housing comprising top plate, a front wall, and a first and second sidewall, joining said top plate and front wall, and thereby creating a cavity; mounted within said cavity is a locking assembly comprising an actuator, a first cam and a second cam, said first cam comprising unlock and a lock indicator surfaces; said actuator comprising a manually graspable portion and a shaft, said shaft extending through an orifice in said top plate and being adapted to move said first cam and said second cam, said first cam being adapted to engage, through an opening in said front wall, a keeper as said actuator is rotated from a first position to a second position, and said first cam being adapted to disengage the keeper as said actuator is rotated from said second position to said first position one of said top plate and front wall of said housing having a viewing orifice surface; said viewing orifice positioned such that only a portion of said unlock indication surface of said first cam indicating said sash lock is in an unlocked position is visible through said viewing orifice when said first cam is in a said first position, and only a portion of said lock indication surface of said first cam indicating said sash lock is in an locked position is visible through said orifice when said first cam is in second position.

2. A sash lock for a sash window assembly comprising a housing; said housing comprising top plate, a front wall, and a first and second sidewall, joining said top plate and front wall, and thereby creating a cavity; mounted with said cavity is a locking assembly comprising an actuator, a first cam and a second cam, said first cam having lock and unlock indication surfaces and said actuator comprising a manually graspable portion and a shaft, said shaft extending through an orifice in said top surface and being adapted to move said first cam and said second cam, said first cam being adapted to engage, through an opening in said front side wall, a keeper as said actuator is moved from a first position to a second position, and said first cam being adapted to disengage the keeper as said actuator is moved from said second position to said first position one of said top plate and front wall of said housing having a viewing orifice such that a portion of said unlock indication surface on said first cam is visible through said orifice indicating that the locking assembly is in an unlocked position when said first cam is in said first position using a first color, and a portion of said lock indication surface on said first cam is visible through said orifice indicating that the locking assembly is in a locked position when said first cam is in said second position using a second color, wherein said second color is different than said first color.

3. A sash lock for a sash window assembly comprising a housing; said housing comprising top plate, a front wall, and a first and second sidewall, joining said top plate and front wall, and thereby creating a cavity; mounted within said cavity is a locking assembly comprising an actuator, a first cam and a second cam, said first cam having lock and unlock indication surfaces; said actuator comprising a manually graspable portion and a shaft, said shaft extending through an orifice in said top surface and being adapted to move said first cam and said second cam, said first cam being adapted to engage, through an opening in said front side wall, a keeper as said actuator is moved from a first position to a second position, and said first cam being adapted to disengage the keeper as said actuator is moved from said second position to said first position, one of said top plate and front wall of said housing having a viewing surface; said viewing surface comprising an orifice positioned on said viewing surface such that a portion of said unlock indication surface of said first cam indicating said sash lock is in an unlocked position is visible through said orifice when said first cam is in a said first position, and a portion of said lock indication surface of said first cam indicating said sash lock is in an locked position is visible through said orifice when said first cam is in said second position.

4. A sash lock for a sash window assembly comprising a housing; said housing having a cavity formed by a top surface, a pair of side walls extending from said top surface and a front wall, said housing having a locking assembly mounted in said cavity, said locking assembly comprising an actuator, a first cam and a second cam, said first cam having lock and unlock indication surfaces; said actuator comprising a manually graspable portion and a shaft, said shaft extending through an orifice in said top surface and being adapted to move said first cam and said second cam, said first cam being adapted to engage, through an opening in said front side wall, a keeper as said actuator is moved from a first position to a second position, and said first cam being adapted to disengage the keeper as said actuator is moved from said second position to said first position; one of said top plate and front wall of said housing having a viewing surface; said viewing surface comprising an orifice positioned on said viewing surface such that a portion of said unlock indication surface of said first cam indicating said sash lock is in an unlocked position is visible through said orifice when said first cam is in a said position, and a portion of said lock indication surface of said first cam indicating said sash lock is in an locked position is visible through said orifice when said first cam is in said second position.

5. The sash lock according to claim 4 wherein said second cam prevents unauthorized access to the first cam.

6. The sash lock according to claim 4 wherein said manually graspable portion of said actuator has a cavity formed therein to hold a spring, and a sliding member; said housing that having one or more grooves in a surface of said housing said sliding member being forced into said groove by said spring to provide a tactile signal when said sliding member is in said groove.

7. The sash lock according to claim 4 wherein said shaft of said actuator has said first cam and said second cam rotatably mounted on said shaft, said first cam having a groove on a surface thereof that engages a protrusion on said second cam, said protrusion causing the first cam to rotate and engage a keeper.

8. The sash lock according to claim 7 wherein the first cam has a sloping surface that engages said keeper.

9. The sash lock according to claim 8 wherein the actuator has a top surface and a bottom portion, said bottom portion having a cavity, a plate affixed to the cavity and supporting a sliding member so that the sliding member may slide relative to the handle.

10. The sash lock according to claim 4 wherein said indication surfaces are located on a portion of the sidewall of said first cam when said viewing orifice is located on the front wall.

11. The sash lock according to claim 4 wherein said indication surfaces are located on a portion on the top surface of said first cam when said viewing orifice is located on the top plate.

12. The sash lock according to claim 4 wherein said unlock indicator surface has a first color representing the lock being in an unlocked position; said lock indicator surface has a second color representing the lock being in an locked position; said second color being different than the first color.

13. The sash lock according to claim 4 wherein said lock indicator surface is a tactile indicator representing the lock being in an locked position.

14. A sash lock for a sash window assembly comprising a housing; said housing having a cavity formed by a top surface, a pair of side walls extending from said top surface and a front wall, said housing having a locking assembly mounted in said cavity, said locking assembly comprising an actuator, a first cam and a second cam, said first cam having lock and unlock indication surfaces; said actuator comprising a manually graspable portion and a shaft, said shaft extending through an orifice in said top surface and being adapted to move said first cam and said second cam, said first cam being adapted to engage, through an opening in said front side wall, a keeper as said actuator is moved from a first position to a second position, and said first cam being adapted to disengage the keeper as said actuator is moved from said second position to said first position, one of said top plate and front wall of said housing having a viewing surface; said viewing surface comprising an orifice positioned on said viewing surface such that a portion of said unlock indication surface of said first cam indicating said sash lock is in an unlocked position with a first color visible through said orifice when said first cam is in a said first position, and a portion of said lock indication surface of said first cam indicating said sash lock is in an locked position is visible through said orifice when said first cam is in said second position with a second color, where second color is different than said first color.

15. The sash lock according to claim 14 wherein said second cam prevents unauthorized access to the first cam.

16. The sash lock according to claim 14 wherein said manually graspable portion of said actuator has a cavity formed therein to hold a spring, and a sliding member; said housing that having one or more grooves in a surface of said housing said sliding member being forced into said groove by said spring to provide a tactile signal when said sliding member is in said groove.

17. The sash lock according to claim 14 wherein said shaft of said actuator has said first cam and said second cam rotatably mounted on said shaft, said first cam having a groove on a surface thereof that engages a protrusion on said second cam said protrusion causing the first cam to rotate and engage a keeper.

18. The sash lock according to claim 17 wherein the first cam has a sloping surface that engages said keeper.

19. The sash lock according to claim 18 wherein the actuator has a top surface and a bottom portion, said bottom portion having a cavity, a plate affixed to the cavity and supporting a sliding member so that the sliding member may slide relative to the handle.

20. The sash lock according to claim 14 wherein said indication surfaces are located on a portion of the sidewall of said first cam when said viewing orifice is located on the front wall.

21. The sash lock according to claim 14 wherein said indication surfaces are located on a portion of the top surface of said first cam when said viewing orifice is located on the top plate.

22. A sash lock for a sash window assembly comprising a housing; said housing having a cavity formed by a top surface, a pair of side walls extending from said top surface and a front wall, said housing having a locking assembly mounted in said cavity, said locking assembly comprising an actuator, a first cam and a second cam, said first cam having lock and unlock indication surfaces; said actuator comprising a manually graspable portion and a shaft, said shaft extending through an orifice in said top surface and being adapted to move said first cam and said second cam, said first cam being adapted to engage, through an opening in said front side wall, a keeper as said actuator is moved from a first position to a second position, and said first cam being adapted to disengage the keeper as said actuator is moved from said second position to said first position, one of said top plate and front wall of said housing having an orifice positioned on said viewing surface such that a portion of said unlock indication surface of said first cam indicating said sash lock is in an unlocked position with a first tactile indication accessible through said orifice when said first cam is in a said first position, and a portion of said lock indication surface of said first cam indicating said sash lock is in an locked position is visible through said orifice when said first cam is in said second position with a second tactile indicator that is accessible through said orifice.

23. The sash lock according to claim 22 wherein said second cam prevents unauthorized access to the first cam.

24. The sash lock according to claim 22 wherein said manually graspable portion of said actuator has a cavity formed therein to hold a spring, and a sliding member; said housing that having one or more grooves in a surface of said housing said sliding member being forced into said groove by said spring to provide a tactile signal when said sliding member is in said groove.

25. The sash lock according to claim 22 wherein said shaft of said actuator has said first cam and said second cam rotatably mounted on said shaft, said first cam having a groove on a surface thereof that engages a protrusion on said second cam said protrusion causing the first cam to rotate and engage a keeper.

26. The sash lock according to claim 25 wherein the first cam has a sloping surface that engages said keeper.

27. The sash lock according to claim 26 wherein the actuator has a top surface and a bottom portion, said bottom portion having a cavity, a plate affixed to the cavity and supporting a sliding member so that the sliding member may slide relative to the handle.

28. The sash lock according to claim 22 wherein said indication surfaces are located on a portion of the sidewall of said first cam when said viewing orifice is located on the front wall.

29. The sash lock according to claim 22 wherein said indication surfaces are located on a portion of the top surface of said first cam when said viewing orifice is located on the top plate.

* * * * *